US006325502B1

(12) United States Patent
Shioya et al.

(10) Patent No.: US 6,325,502 B1
(45) **Date of Patent: *Dec. 4, 2001**

(54) INK JET PRINTING APPARATUS THAT EJECTS INK AND PROCESSING LIQUID FOR PRINTING

(75) Inventors: Makoto Shioya, Tokyo; Ken Tsuchii, Sagamihara, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/600,051

(22) Filed: Feb. 12, 1996

(30) Foreign Application Priority Data

Feb. 13, 1995 (JP) ..... 7-023588

(51) Int. Cl.[7] ..... B41J 2/21; B41J 2/17; B41J 2/01

(52) U.S. Cl. ..... 347/101; 347/96; 347/43

(58) Field of Search ..... 347/96, 43, 41, 347/101

(56) References Cited

U.S. PATENT DOCUMENTS

| | | | | |
|---|---|---|---|---|
| 4,313,124 | | 1/1982 | Hara | 346/140 R |
| 4,313,684 | * | 2/1982 | Tazaki et al. | 400/322 |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,538,160 | | 8/1985 | Uchiyama | 346/140 R |
| 4,558,333 | | 12/1985 | Sugitani et al. | 346/140 R |
| 4,608,577 | | 8/1986 | Hori | 346/140 R |
| 4,723,129 | | 2/1988 | Endo et al. | 346/1.1 |
| 4,740,796 | | 4/1988 | Endo et al. | 346/1.1 |
| 4,748,453 | * | 5/1988 | Lin et al. | 346/1.1 |
| 4,836,852 | * | 6/1989 | Knirsch et al. | 106/22 |
| 4,965,593 | * | 10/1990 | Hickman | 346/140 R |
| 4,967,203 | | 10/1990 | Doan et al. | 347/15 |
| 5,353,387 | * | 10/1994 | Petschik et al. | 395/109 |
| 5,430,469 | | 7/1995 | Shioya et al. | 346/1.1 |
| 5,635,969 | * | 6/1997 | Allen | 347/96 |

FOREIGN PATENT DOCUMENTS

| | | | |
|---|---|---|---|
| 54056847 | | 5/1979 | (JP) . |
| 55084992 | | 6/1980 | (JP) . |
| 58128862 | | 8/1983 | (JP) . |
| 59123670 | | 7/1984 | (JP) . |
| 59138461 | | 8/1984 | (JP) . |
| 60071260 | | 4/1985 | (JP) . |
| 61249755 | | 11/1986 | (JP) . |
| 63299971 | * | 7/1988 | (JP) . |
| 63312841 | | 12/1988 | (JP) . |
| 6463185 | | 3/1989 | (JP) . |
| 1114450 | | 5/1989 | (JP) . |
| 3207665 | | 9/1991 | (JP) . |
| 4358847 | | 12/1992 | (JP) . |
| 5155036 | | 6/1993 | (JP) . |
| WO87/03363 | | 6/1987 | (WO) . |

* cited by examiner

*Primary Examiner*—John Barlow
*Assistant Examiner*—An H. Do
(74) *Attorney, Agent, or Firm*—Fitzpatrick, Cella, Harper & Scinto

(57) ABSTRACT

An apparatus for performing printing by employing an ink and a liquid which insolubilizes or coagulates the ink, in order to effectively obtain an effect of using the liquid and to improve printing quality, is provided. The liquid S to be applied to respective pixels of regions printed by performing two scanning cycles, is applied to different two patterns of pixels from each other during first and second scanning cycles.

28 Claims, 16 Drawing Sheets

FIG.1(a) R2 PRINT DATA

| | FIRST SCANNING CYCLE | SECOND SCANNING CYCLE |
|---|---|---|
| FIG.1(b) | Y M | Y M |
| FIG.1(c) | Y M S | Y M |
| FIG.1(d) | Y S M | Y M |
| FIG.1(e) | S Y M | Y M |
| FIG.1(f) | Y M | Y M S |
| FIG.1(g) | Y M | Y S M |
| FIG.1(h) | Y M | S Y M |

| 1 | 2 | 3 | 4 | 5 | 6 | 7 | 8 | 9 | 10 |
|---|---|---|---|---|---|---|---|---|---|
| $Y_1$ | $Y_1$ | $Y_2$ | $Y_2$ | $R_2$ | $R_2$ | $G_2$ | $G_2$ | $B_2$ | $B_2$ |
| | $Y_1$ | $Y_2$ | $Y_2$ | $R_2$ | $R_2$ | $G_2$ | $G_2$ | $B_2$ | $B_2$ |
| $Y_1$ | $Y_1$ | $Y_2$ | $Y_1$ | $R_2$ | $R_1$ | $G_2$ | $G_1$ | $B_2$ | $B_1$ |

PRINT DATA

FIG.5A

| 1 | 2 | 3 | 4 | 5 | 6 | 7 | 8 | 9 | 10 |
|---|---|---|---|---|---|---|---|---|---|
| Y | Y | YY | YY | YY MM | YY MM | YY CC | YY CC | MM CC | MM CC |
| | Y | YY | YY | YY MM | YY MM | YY CC | YY CC | MM CC | MM CC |
| Y | Y | YY | Y | YY MM | Y M | YY CC | Y C | MM CC | M C |

INK EJECTING DATA

FIG.5B

| 1 | 2 | 3 | 4 | 5 | 6 | 7 | 8 | 9 | 10 |
|---|---|---|---|---|---|---|---|---|---|
| Y | | Y | Y | Y | Y | Y | Y | | |
| | Y | Y | Y | Y | Y | Y | Y | | |
| Y | | Y | Y | Y | | Y | Y | | |

Y EJECTING DATA FOR FIRST SCANNING CYCLE

FIG.5C

| 1 | 2 | 3 | 4 | 5 | 6 | 7 | 8 | 9 | 10 |
|---|---|---|---|---|---|---|---|---|---|
| | Y | Y | Y | Y | Y | Y | Y | | |
| | | Y | Y | Y | Y | Y | Y | | |
| | Y | Y | | Y | Y | Y | | | |

Y EJECTING DATA FOR SECOND SCANNING CYCLE

FIG.5D

| 1 | 2 | 3 | 4 | 5 | 6 | 7 | 8 | 9 | 10 |
|---|---|---|---|---|---|---|---|---|---|
| | | | | M | M | | | M | M |
| | | | | M | M | | | M | M |
| | | | | M | M | | | M | |

M EJECTING DATA FOR FIRST SCANNING CYCLE

FIG.5E

| 1 | 2 | 3 | 4 | 5 | 6 | 7 | 8 | 9 | 10 |
|---|---|---|---|---|---|---|---|---|---|
| | | | | M | M | | | M | M |
| | | | | M | M | | | M | M |
| | | | | M | | | | M | M |

M EJECTING DATA FOR SECOND SCANNING CYCLE

FIG.5F

| 1 | 2 | 3 | 4 | 5 | 6 | 7 | 8 | 9 | 10 |
|---|---|---|---|---|---|---|---|---|---|
| | | | | | | C | C | C | C |
| | | | | | | C | C | C | C |
| | | | | | | C | C | C | |

C EJECTING DATA FOR FIRST SCANNING CYCLE

FIG.5G

| 1 | 2 | 3 | 4 | 5 | 6 | 7 | 8 | 9 | 10 |
|---|---|---|---|---|---|---|---|---|---|
| | | | | | | C | C | C | C |
| | | | | | | C | C | C | C |
| | | | | | | C | | C | C |

C EJECTING DATA FOR SECOND SCANNING CYCLE

FIG.5H

| 1 | 2 | 3 | 4 | 5 | 6 | 7 | 8 | 9 | 10 |
|---|---|---|---|---|---|---|---|---|---|
| S | | S | | S | | S | | S | |
| | S | | S | | S | | S | | S |
| S | | S | | S | | S | | S | |

S EJECTING DATA FOR FIRST SCANNING CYCLE

FIG.5I

| 1 | 2 | 3 | 4 | 5 | 6 | 7 | 8 | 9 | 10 |
|---|---|---|---|---|---|---|---|---|---|
| | S | | S | | S | | S | | S |
| | | S | | S | | S | | S | |
| | S | | S | | S | | S | | S |

S EJECTING DATA FOR SECOND SCANNING CYCLE

FIG.5J

| 1 | 2 | 3 | 4 | 5 | 6 | 7 | 8 | 9 | 10 |
|---|---|---|---|---|---|---|---|---|---|
| $Y_S$ | | $Y_S$ | Y | $Y_{M_S}$ | $Y_M$ | $Y_{C_S}$ | $Y_C$ | $M_{C_S}$ | $M_C$ |
| | $Y_S$ | Y | $Y_S$ | $Y_M$ | $Y_{M_S}$ | $Y_C$ | $Y_{C_S}$ | $M_C$ | $M_{C_S}$ |
| $Y_S$ | | $Y_S$ | Y | $Y_{M_S}$ | M | $Y_{C_S}$ | $Y_C$ | $M_{C_S}$ | |

ORDER OF EJECTING INK AND S FOR FIRST SCANNING CYCLE

FIG.5K

| 1 | 2 | 3 | 4 | 5 | 6 | 7 | 8 | 9 | 10 |
|---|---|---|---|---|---|---|---|---|---|
| | $Y_S$ | Y | $Y_S$ | $Y_M$ | $Y_{M_S}$ | $Y_C$ | $Y_{C_S}$ | $M_C$ | $M_{C_S}$ |
| | | $Y_S$ | Y | $Y_{M_S}$ | $Y_M$ | $Y_{C_S}$ | $Y_C$ | $M_{C_S}$ | $M_C$ |
| | $Y_S$ | Y | S | $Y_M$ | $Y_S$ | $Y_C$ | S | $Y_C$ | $M_{C_S}$ |

ORDER OF EJECTING INK AND S FOR SECOND SCANNING CYCLE

FIG.5L

| 1 | 2 | 3 | 4 | 5 | 6 | 7 | 8 | 9 | 10 |
|---|---|---|---|---|---|---|---|---|---|
| $Y_1$ | $Y_1$ | $Y_3$ | $Y_3$ | $R_2$ | $R_3$ | $G_2$ | $G_3$ | $B_2$ | $B_3$ |
| $Y_1$ | $Y_1$ | $Y_2$ | $Y_3$ | $R_2$ | $R_3$ | $G_2$ | $G_3$ | $B_2$ | $B_3$ |
| $Y_2$ | $Y_2$ | $Y_2$ | $Y_3$ | $R_1$ | $R_2$ | $G_1$ | $G_2$ | $B_1$ | $B_2$ |

FIG. 7A

| 1 | 2 | 3 | 4 | 5 | 6 | 7 | 8 | 9 | 10 |
|---|---|---|---|---|---|---|---|---|---|
| Y | Y | YYY | YYY | YY<br>MM | YYY<br>MMM | YY<br>CC | YYY<br>CCC | MM<br>CC | MMM<br>CCC |
| Y | Y | YY | YYY | YY<br>MM | YYY<br>MMM | YY<br>CC | YYY<br>CCC | MM<br>CC | MMM<br>CCC |
| YY | YY | YY | YYY | Y<br>M | YY<br>MM | Y<br>C | YY<br>CC | M<br>C | YY<br>CC |

FIG. 7B

| 1 | 2 | 3 | 4 | 5 | 6 | 7 | 8 | 9 | 10 |
|---|---|---|---|---|---|---|---|---|---|
| Y | | Y | Y | M Y | M Y | C | C Y | C M | C M |
| Y | | Y | Y | M | M Y | C Y | C Y | C M | C M |
| Y | Y | | Y | M Y | | C Y | | C M | |

FIRST SCANNING CYCLE

FIG.7C

| 1 | 2 | 3 | 4 | 5 | 6 | 7 | 8 | 9 | 10 |
|---|---|---|---|---|---|---|---|---|---|
| | Y | Y | Y | M | M Y | C Y | C Y | | C M |
| | Y | | Y | M Y | M Y | C Y | C Y | | C M |
| Y | | Y | Y | | M Y | | C Y | | C M |

SECOND SCANNING CYCLE

FIG.7D

| 1 | 2 | 3 | 4 | 5 | 6 | 7 | 8 | 9 | 10 |
|---|---|---|---|---|---|---|---|---|---|
| | | Y | Y | Y | M Y | Y | C Y | C M | C M |
| | | Y | Y | Y | M Y | | C Y | C M | C M |
| | Y | Y | Y | | M Y | | C Y | | C M |

THIRD SCANNING CYCLE

FIG.7E

| 1 | 2 | 3 | 4 | 5 | 6 | 7 | 8 | 9 | 10 |
|---|---|---|---|---|---|---|---|---|---|
| S | | | S | | | S | | | S |
| | S | | | S | | | S | | |
| | | S | | | S | | | S | |

FIRST SCANNING CYCLE

FIG.7F

| 1 | 2 | 3 | 4 | 5 | 6 | 7 | 8 | 9 | 10 |
|---|---|---|---|---|---|---|---|---|---|
| | S | | | S | | | S | | |
| | | S | | | S | | | S | |
| S | | | S | | | S | | | S |

SECOND SCANNING CYCLE

FIG.7G

| 1 | 2 | 3 | 4 | 5 | 6 | 7 | 8 | 9 | 10 |
|---|---|---|---|---|---|---|---|---|---|
| | | S | | | S | | | S | |
| S | | | S | | | S | | | S |
| | S | | | S | | | S | | |

THIRD SCANNING CYCLE

FIG.7H

| 1 | 2 | 3 | 4 | 5 | 6 | 7 | 8 | 9 | 10 | |
|---|---|---|---|---|---|---|---|---|---|---|
| | | | | | | | | | | FIRST SCANNING CYCLE |
| | | | | | | | | | | |
| | | | | | | | | | | |

FIG.8A

| 1 | 2 | 3 | 4 | 5 | 6 | 7 | 8 | 9 | 10 | |
|---|---|---|---|---|---|---|---|---|---|---|
| S | | S | | S | | S | | S | | SECOND SCANNING CYCLE |
| | S | | S | | S | | S | | S | |
| S | | S | | S | | S | | S | | |

FIG.8B

| 1 | 2 | 3 | 4 | 5 | 6 | 7 | 8 | 9 | 10 | |
|---|---|---|---|---|---|---|---|---|---|---|
| | S | | S | | S | | S | | S | THIRD SCANNING CYCLE |
| S | | S | | S | | S | | S | | |
| | S | | S | | S | | S | | S | |

FIG.8C

| 1 | 2 | 3 | 4 | 5 | 6 | 7 | 8 | 9 | 10 |
|---|---|---|---|---|---|---|---|---|---|
| S | | S | | S | | S | | S | |
| | S | | S | | S | | S | | S |
| S | | S | | S | | S | | S | |

FIRST SCANNING CYCLE

FIG.9A

| 1 | 2 | 3 | 4 | 5 | 6 | 7 | 8 | 9 | 10 |
|---|---|---|---|---|---|---|---|---|---|
| | | | | | | | | | |
| | | | | | | | | | |
| | | | | | | | | | |

SECOND SCANNING CYCLE

FIG.9B

| 1 | 2 | 3 | 4 | 5 | 6 | 7 | 8 | 9 | 10 |
|---|---|---|---|---|---|---|---|---|---|
| | S | | S | | S | | S | | S |
| S | | S | | S | | S | | S | |
| | S | | S | | S | | S | | S |

THIRD SCANNING CYCLE

FIG.9C

INK JET PRINTING APPARATUS THAT EJECTS INK AND PROCESSING LIQUID FOR PRINTING

FIELD OF THE INVENTION

The present invention relates to an ink-jet printing apparatus and an ink-jet printing method and, more specifically, to an ink-jet printing apparatus and an ink-jet printing method for performing printing which insolubilizes or coagulates a color component contained in the ink, onto a printing medium.

DESCRIPTION OF THE RELATED ART

An ink-jet printing system is widely employed in printing apparatus, copying machines, facsimile equipment and so forth because of its advantages in lowering noise, reducing running costs, and facilitating the miniaturization of apparatuses and the design of color printing apparatuses.

Most conventional ink-jet printing systems employ a special printing sheet provided with a waterproof ink absorbing layer to secure satisfactory water-resistance of the ink thereon and to print a color image of high coloring without bleeding of ink. Recent improvement of ink has increased the printability of an ordinary printing sheet, which are used in large quantities on printing apparatus, copying machines and the like. However, the print quality of images printed on the ordinary printing sheets is not yet perfectly satisfactory. There have been proposed some arts to improve the water-registered property of the ordinary printing sheet and to improve printing quality.

As one method of improving the water-resistance property of the image through the improvement of ink, for example, a method of making a coloring component in the ink have the water-resistance property is known. This prior method, however, uses an ink which nearly becomes soluble to water after drying. Therefore, an ejection opening of an ink-jet head using such an ink is liable to be clogged with a dried ink. In addition, although it is possible to realize structure for preventing the ejection openings from being clogged, a problem that the structure requires a complex mechanism occurs.

In Japanese Patent Application Laid-open No. 84992/1980, there is disclosed a method which uses a printing medium coated with a dye fixing material. This prior method, however, needs to use a special printing medium capable of being coated with the dye fixing material, needs to use a large apparatus for coating the printing medium with the dye fixing material, and, unavoidably, increases the cost of the apparatus. Furthermore, it is comparatively difficult. to coat the printing medium with a film of the dye fixing material having a predetermined thickness.

To improve printing quality, it is required that 1) characters and images must be sharply printed without occurring irregular blurring of ink on an edge of ink dots (hereinafter referred to as "feathering"), and that 2) an image is clearly printed without bleeding, i.e., without mixing of inks occurring on a boundary between adjacent regions of respective different colors. The ink must be prevented from permeating the printing medium to prevent feathering stated at an article 1). In such case, however, aqueous inks, which are used by common ink-jet printing system, are liable to cause bleeding stated at an article 2). In contrast, in the case of facilitating the permeation of the ink into the printing medium, feathering is enhanced although bleeding stated at the article 2) can be reduced.

In order to solve a problem set forth above, there is proposed, in Japanese Patent Application Laid-open No. 63185/1989 and Japanese Patent Application Laid-open No. 249755/1986, arts in which a clear liquid that insolubilizes the dye contained in the ink is deposited together with the ink on the printing medium by employing ink-jet head.

According to methods stated above, the colored ink deposited on the printing medium is insolubilized to be fixed on the printing medium and hence a high water-resistance property of the printed product can be obtained. Both feathering and bleeding can be suppressed by applying a clear processing liquid to the printing medium under given conditions prior to ejecting ink on the printing medium.

On the other hand, there are known an ink-jet printing method of a multi-scanning system disclosed in Japanese Patent Application Laid-open Nos. 358847/1992 and 155036/1993 and an ink-jet printing method of a multi-pass system disclosed in Japanese Patent Application Laid-open No. 207665/1991 employing a plurality of scanning cycles of an ink-jet head along a scanning direction to form one line of pixels. According to an above described method, one line of pixels are formed by ink droplets ejected through a plurality of different ejection openings. Therefore, variations among the ejection openings in ejection volume and an ejecting direction are averaged, so that density unevenness and landings are not liable to occur and high-quality printing can be realized.

Incidentally, the use of the aforesaid processing liquid in the foregoing multi-scanning system entails the following problems.

In this case that the processing liquid is ejected once for one ink ejecting cycle as mentioned in Japanese Patent Application Laid-open No. 63185/1989, the processing liquid is deposited in an overlapping manner in the multi-scanning system, so that an excessive quantity of the processing liquid may be applied to the printing medium. As a result of this, the printing medium to which the excessive processing liquid is applied becomes a cockling state which makes the surface of the printing medium rugged. And the cockled printing medium interferes with the ink-jet head and the internal components of the printing apparatus, and the cockled printing medium may possibly cause jamming and smear the printed printing medium with the ink. In some cases, the image printed on the printing medium is difficult to see and printing quality is deteriorated when the cockled printing medium dries in cockle state.

Furthermore, since such a mode of printing consumes a large quantity of the processing liquid, a tank containing the processing liquid needs to be changed or to be replenished with the processing liquid frequently, the running cost is increased, and the load on the user increases. In case that a tank having an increased size is used to save work for changing the tank, the size of the printing apparatus needs to be increased, a cost of the printing apparatus is increased, and an operability of the printing apparatus is spoiled.

A method of reducing a deposition amount of the processing liquid is proposed in, for example, Japanese Patent Application Laid-open No. 128862/1983. In this prior art, when printing with a plurality of kinds of inks, a data for ejecting the processing liquid is generated by carrying out logical OR between data for ejecting respective inks of colors. According to a method set forth above, when performing printing of R (red) by ejecting one Y ink (Yellow) droplet and one M ink (magenta) droplet, one processing liquid droplet for each of the Y- and the M-ink droplets are not ejected but only one processing liquid droplet is ejected. An effect of ejecting only one processing liquid droplet for two ink droplets in preventing feathering and bleeding is scarcely different from that of ejecting two processing liquid droplets for two ink droplets, the water resistance is improved effectively, and consumption of the processing liquid is reduced by ½ to ⅓ the consumption of the same by the conventional method. Even if this method is employed, however, the consumption of the processing liquid, as compared with the consumption of the ink, is considerably large.

Suppose that a full-color image is printed with, for example, a Y-ink (yellow ink), an M-ink (magenta ink), a C-ink (cyan ink) and a Bk-ink (black ink) by employing the aforesaid method which carries out logical OR between the data for ejecting respective inks, an amount of the processing liquid required for printing a primary color portion, a second color portion and a third color portion are equal to, half and ⅓ the total amount of the inks for printing the primary color portion, the second color portion and the third color portion, respectively. In such case, suppose that an image to be printed consists of the primary color patterns of the four color inks having the same area, the second color patterns of six colors of the four color inks having the same area, or the third color patterns of the four color inks having the same area, the amount of the processing liquid necessary for printing the image is four times, two times or about 1.3 times the amount of each of the four color inks, respectively. Although one cannot make that kind of sweeping generalization because different images has different ratios in area between the primary color, the second color and the third color patterns, the amount of the processing liquid necessary for printing an image is, in an average, two to three times the amount of each color ink necessary for printing the same image.

To apply one processing liquid droplet for one pixel formed of a plurality of ink droplets ejected in a plurality of scanning cycles is a possible effective method for solving a foregoing problem in the consumption of the processing liquid. FIG. 1 illustrates an example of such method. In (a) of FIG. 1, print data "R2" indicates printing of a red portion with a tone level 2, and such red portion is printed with two Y-ink droplets and two M-ink droplets. These ink droplets Y and M are ejected in two scanning cycles, i.e., a first scanning cycle and a second scanning cycle, and one droplet of the Y ink and one droplet of the M ink are ejected in each scanning cycle as shown in (b) of FIG. 1.

In such case, when one processing liquid S (hereinafter also referred to simply as "liquid S") is used for forming the red portion, the liquid S can be ejected in one of printing modes shown in (c) to (h) of FIG. 1. In the printing mode shown in (c) of FIG. 1, the liquid S is ejected first in the first scanning cycle followed by the ink droplets M and Y. Therefore, the ink droplets M and Y are ejected onto a position when the liquid S is deposited and hence the inks and the processing liquid are able to interact.

However, the effect of the liquid S on a succeeding ink which is ejected some time after the liquid S has been ejected, e.g., the Y-ink ejected in the second scanning cycle of the printing mode shown in (c) of FIG. 1, is reduced and there are preceding ink on the printing medium, the succeeding ink droplet is liable to move into the adjacent pixels and to cause bleeding.

Furthermore, if the amount of the processing liquid ejected in the first scanning cycle is comparatively large, cockling is liable to occur. In such case, the printing modes shown in (d) and (e) of FIG. 1 are inferior to the printing mode shown in (c) of FIG. 1 in developing of color and feathering suppressing effect, on substantially the same level as the latter in cockling causing effect and hence not very advantageous.

In contrast, although the printing modes shown in (f) and (g) of FIG. 1 are considerably effective in suppressing bleeding and cockling, these printing modes are rather unsatisfactory in developing of color effect and liable to cause feathering because the ink is ejected onto the printing medium in the first scanning cycle in which no liquid S is ejected. Such adverse effects are more conspicuous with the printing mode shown in (g) of FIG. 1 than with that shown in (f) of FIG. 1. Inferior coloring and feathering are more conspicuous in the printing mode shown in (h) of FIG. 1.

SUMMARY OF THE INVENTION

Accordingly, it is an object of the present invention to provide an ink-jet printing apparatus of a multi-scanning or multi-pass system capable of effectively utilizing effects of a processing liquid, and to provide an ink-jet printing method.

Another object of the present invention is to provide an ink-jet printing apparatus capable of ejecting a processing liquid in a plurality of scanning cycles respectively for divisions of a region to be printed, so that the processing liquid acts effectively on ink in each division of the region and problems attributable to the use of the processing liquid are suppressed, and to provide an ink-jet printing method.

In a first aspect of the present invention, there is provided an ink-jet printing apparatus for performing printing by ejecting an ink from an ink ejecting portion and a liquid at least containing a material which insolubilizes or coagulates a coloring material in the ink from a liquid ejecting portion, to a printing medium, the apparatus comprising:

a printing controller for dividing a predetermined print region to be printed by the ink ejected from the ink ejecting portion in accordance with a pixel pattern, and for performing ejection of the liquid from the liquid ejecting portion for each of a plurality of divided regions.

In a second aspect of the present invention, there is provided an ink-jet printing method for performing printing by ejecting an ink and a liquid at least containing a material which insolubilizes or coagulates a coloring material in the ink, to a printing medium, the method comprising the steps of:

providing an ink ejecting portion for ejecting the ink, and a liquid ejecting portion for ejecting the liquid;

ejecting the ink from the ink ejecting portion onto a predetermined region on a printing medium; and ejecting the liquid from the liquid ejecting portion at a plurality of divided timings.

In a third aspect of the present invention, there is provided an image forming apparatus comprising:

(a) an ink-jet printing apparatus for performing printing by ejecting an ink from an ink ejecting portion and a liquid at least containing a material which insolubilizes or coagulates a coloring material in the ink from a liquid ejecting portion, to a printing medium, the apparatus comprising:

a printing controller for dividing a predetermined print region to be printed by the ink ejected from the ink ejecting portion in accordance with a pixel pattern, and for performing ejection of the liquid from the liquid ejecting portion for each of a plurality of divided regions; and (b) an image reading unit for reading an original image; wherein the ink-jet printing apparatus performs printing on a basis of print data representing the original image read by the image reading unit.

In a fourth aspect of the present invention, there is provided an image forming apparatus comprising:

(a) an ink-jet printing apparatus for performing printing by ejecting an ink from an ink ejecting portion and a liquid at least containing a material which insolubilizes or coagulates a coloring material in the ink from a liquid ejecting portion, to a printing medium, the apparatus comprising:

a printing controller for dividing a predetermined print region to be printed by the ink ejected from the ink ejecting portion in accordance with a pixel pattern, and for performing ejection of the liquid from the liquid ejecting portion for each of a plurality of divided regions; and (b) a print data sending and receiving unit capable of sending print data to and receiving print data from an external apparatus;

wherein the ink-jet printing apparatus performs printing on a basis of print data received by the print data sending and receiving unit.

In a fifth aspect of the present invention, there is provided an information processing apparatus comprising:

(a) an ink-jet printing apparatus for performing printing by ejecting an ink from an ink ejecting portion and a liquid at least containing a material which insolubilizes or coagulates a coloring material in the ink from a liquid ejecting portion, to a printing medium, the apparatus comprising:

a printing controller for dividing a predetermined print region to be printed by the ink ejected from the ink ejecting portion in accordance with a pixel pattern, and for performing ejection of the liquid from the liquid ejecting portion for each of a plurality of divided regions; and (b) a computer;

wherein the ink-jet printing apparatus performs printing on a basis of print data provided by the computer.

BRIEF DESCRIPTION OF THE DRAWINGS

FIGS. 1(*a*)–1(*h*) explain a printing method using inks and a processing liquid;

FIGS. 5A to 5L are diagrams explaining an ink-jet printing method of the first embodiment according to the present invention;

FIGS. 7A to 7H are diagrams explaining the ink-jet printing method of the second embodiment;

FIGS. 8A to 8C are diagrams explaining an ink-jet printing method of a third embodiment according to the present invention;

FIGS. 9A to 9C are diagrams explaining an ink-jet printing method of a fourth embodiment according to the present invention;

DESCRIPTION OF THE PREFERRED EMBODIMENTS

Preferred embodiments of the present invention will be described in detail with reference to the accompanying drawings.

Figure 2:
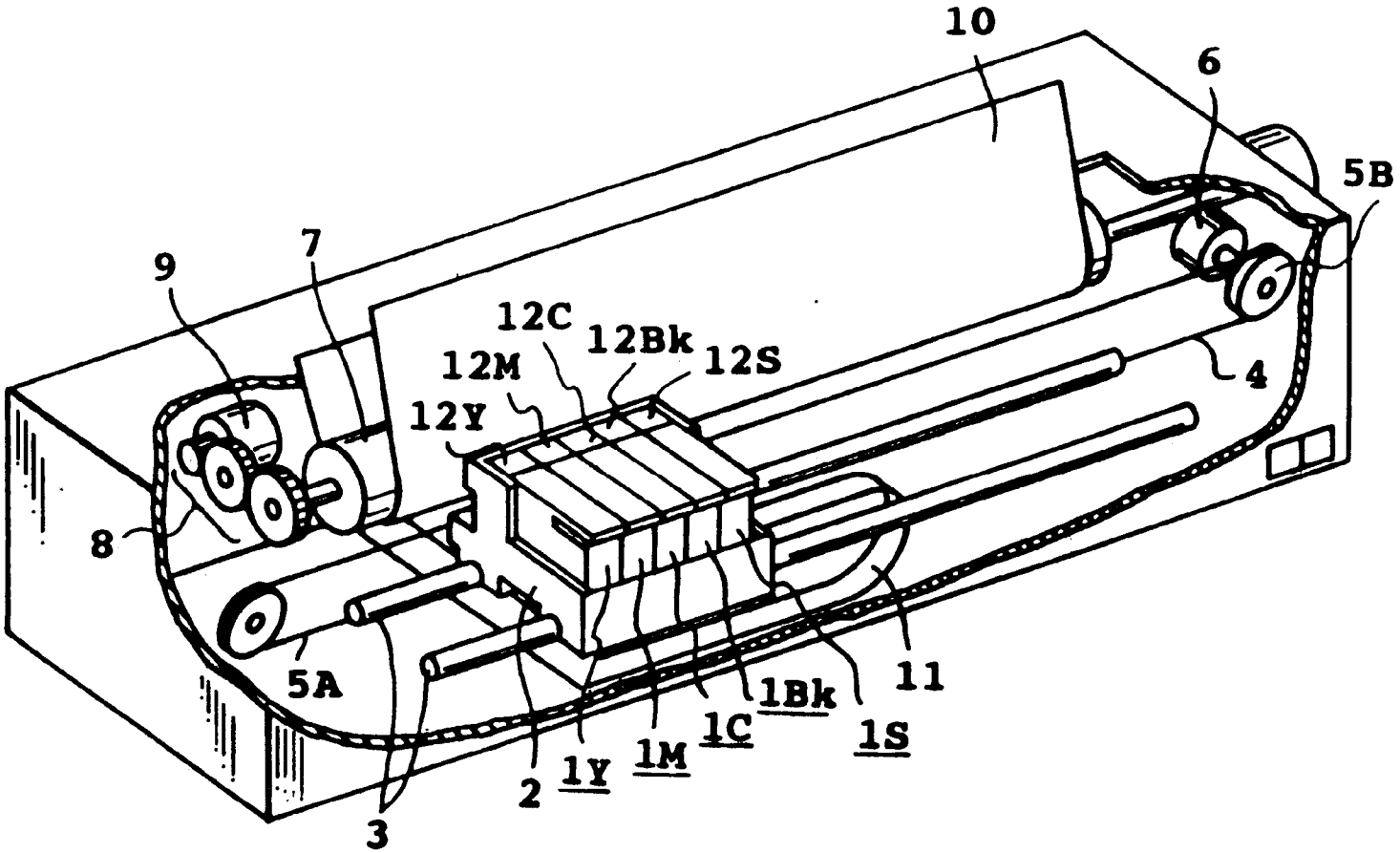
FIG. 2 is a partly cutaway schematic perspective view of an ink-jet printing apparatus of an embodiment according to the present invention.

FIG. 2 is a general perspective view showing a main portion of an ink-jet apparatus.

Referring to FIG. 2, ink jet units 1Y, 1M, 1C, 1Bk and 1S are mounted on a carriage 2, and the ink jet units 1Y, 1M, 1C, 1Bk and 1S comprise heads 12Y, 12M, 12C, 12Bk and 12S respectively for ejecting an Y-ink, an M-ink, a C-ink, a Bk-ink and a liquid S (hereinafter also referred to "processing liquid" S), respectively, and tanks respectively containing the Y-ink, the M-ink, the C-ink, the Bk-ink and the liquid S, respectively. Each of the ink-jet units is provided with, for example, sixteen ejection openings arranged at intervals of 62.5 $\mu$m along the direction in which a printing sheet 10 as a printing medium is fed (hereinafter also referred to as "auxiliary direction"). Heaters to generate thermal energy utilized for ejecting an ink are provided on ink passages connected to the ejection openings, respectively. The respective heaters generate thermal energy in response to application of the electric pulses in accordance with driving data to cause film boiling in the ink or the liquid S, and to produce a bubble so that a droplet of the ink or the liquid S is ejected through the corresponding ejection opening.

The carriage 2 detachably mounted the heads 12Y, 12M, 12C, 12Bk and 12S and the tanks, and is slidably engaged on and travels along two parallel guide shafts 3. The carriage 2 is driven for travel along the guide shafts 3 through a belt 4 fastened to part of the carriage 2 and extended between pulleys 5A and 5B by a carriage motor 6. A flexible cable 11 is connected to the heads 12Y, 12M, 12C, 12Bk and 12S, respectively, so that ink ejecting signals and control signals based on a print data are transformed from a host system or a control portion included in the ink-jet printing apparatus to respective head driver circuits (head drivers) included in the respective heads.

A platen roller 7 is extended with its axis in parallel to axes of the guide shafts 3 and is driven for rotation by a feeding motor 9 to feed the printing sheet 10. The platen roller 7 sets a printing surface of the printing sheet 10 in a plane state. In a construction set forth above, the heads 12Y, 12M, 12C, 12Bk and 12S of the ink jet units 1Y, 1M, 1C, 1Bk and 1S eject the inks onto a printing region of the printing sheet 10 positioned opposite to the ejection openings of the head as the carriage 2 travels for printing.

Figure 3:
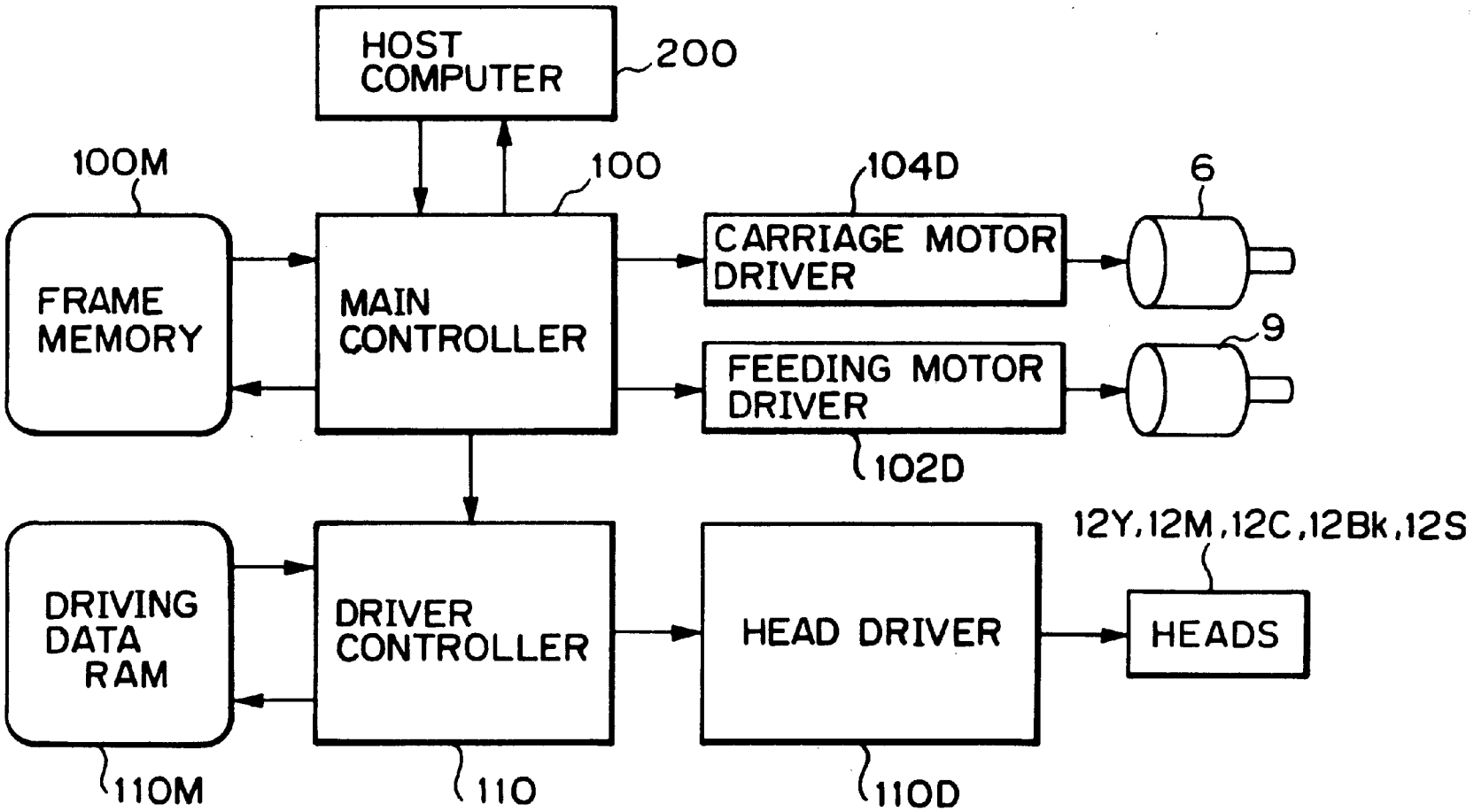
FIG. 3 is a block diagram of a control structure included in the ink-jet printing apparatus of FIG. 2.

FIG. 3 is a block diagram showing control structure included in the ink-jet printing apparatus of FIG. 2. A main controller 100 comprises a CPU or the like, converts image data given thereto from a host computer 200 into pixel data combined with tone data and stores the pixel data in a frame memory 100M. The main controller 100 gives the tone data of the pixels stored in the frame memory 100M to a driver controller 110 at a predetermined timing. The driver controller 110 converts the tone data into ejecting control data representing on/off of the respective heaters which are made to correspond to ejection opening numbers (which indicate an order in one ejection opening array) and to scanning numbers (which indicate a number of scanning cycles). The driver controller 110 reads the driving data corresponding to the ejection opening numbers and the scanning numbers from the driving data RAM 110M according to control signals given from the main controller 100, gives the driving data to a head driver 110D, and controls timing of driving of the head driver 110D.

The main controller 100 controls the ejecting operations of the heads 12Y, 12M, 12C, 12Bk and 12S, the driving operations of the carriage motor 6 and the feeding motor 9 through a carriage motor driver 104D and a feeding motor driver 102D, respectively. Whereby characters or images according to image data are printed on the printing sheet 10.

It should be noted that the main controller 100 may be used instead of the driver controller 110 for converting the tone data into the ejecting data. This structure enables the storage of the ejecting data in the frame memory 100M and the omission of the driving data RAM 110M.

Embodiments of ink-jet printing methods in accordance with the present invention, which methods can be applied to the foregoing ink-jet printing apparatus will be described hereinafter.

Figure 4:
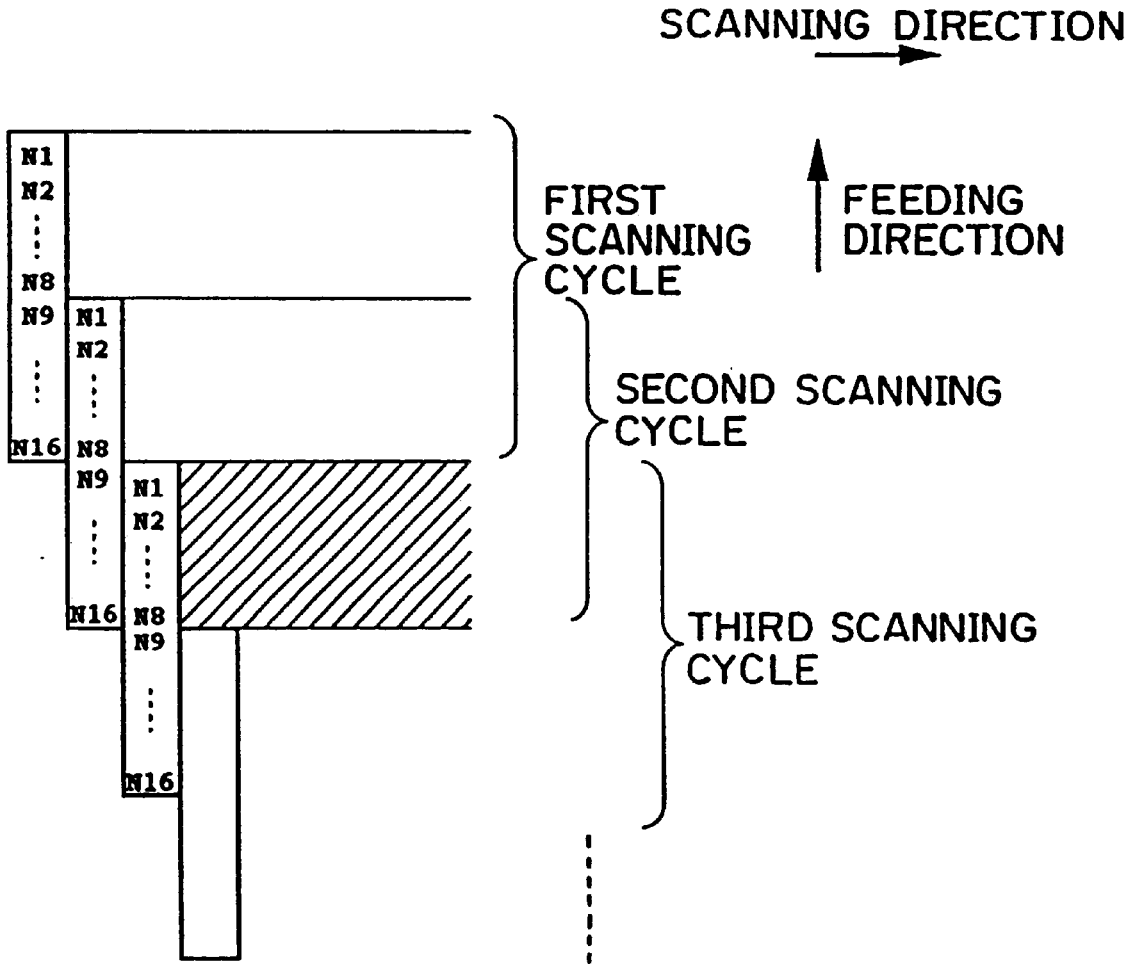
FIG. 4 is a diagrammatic view explaining a printing operation of a first embodiment.

FIG. 4 is a conceptual view illustrating a printing method of one embodiment according to the present invention. It should be noted that in the following description, respective operations of the five heads 12Y, 12M, 12C, 12Bk and 12S will be explained as operation of one head among the five heads.

When performing printing on the printing sheet, the ink is ejected onto a blank region, on which printing is not performed yet, of the printing sheet from the ejection openings N9 to N16 as the carriage 2 travels in a first scanning cycle. In this dot forming, only one of two dots which are a maximum number of dots for forming one pixel is formed.

Then, as shown in FIG. 4, the printing sheet is fed (in FIG. 4, the head is shifted down relative to the printing sheet for convenience sake) by a distance corresponding to the eight ejection openings, and the ejection openings N1 to N16 are used for printing.

Then, the printing sheet is fed again by a distance corresponding to the eight ejection openings and the ejection openings N1 to N16 are used for printing. This printing cycle is thus repeated to perform printing on the entire surface of the printing sheet. It should be noted that when printing the lower end region of the image, the operation of the ejection openings N9 to N16 are stopped and only the ejection openings N1 to N8 are used.

Methods for ejecting the liquid S in different timings to perform printing will be described below.

Before discussion of the methods, the processing liquid (a liquid at least containing a material which insolubilizes or coagulates a coloring material in the ink) and the ink employed in the embodiments will be discussed below.

| Composition of processing liquid | |
|---|---|
| PAA-HC1-3L (Nittoboh, Inc.) | 5.0 wt. % |
| Cation G50 (Sanyo Kasei, Inc.) | 0.3 wt. % |
| Diethylene Glycol | 10.0 wt. % |
| Lithiumacetate | 0.5 wt. % |
| Water | 84.2 wt. % |
| Composition of inks | |
| Glycerine | 7.5 wt. % |
| Thiodiglycol | 7.5 wt. % |
| Urea | 7.5 wt. % |
| Dyestuff | 3.5 wt. % |
| Y C.I. Direct Yellow 142 | |
| M C.I. Acid Red 289 | |
| C C.I. Direct Blue 199 | |
| Bk C.I. Food Black 2 | |
| Acetylenol EH (Kawa-Ken Chemical, Inc.) | 1.0 wt. % |
| Water | 73.0 wt. % |

In mixing of the processing liquid and the ink as set forth above, in the present invention, as a result of mixing of the processing liquid and the ink on the printing medium or at a position penetrating the printing medium in a certain magnitude, as the first stage of reaction, low molecule component or cation type oligomer in the cation type substance contained in the processing liquid, and the water soluble dye having an anion type group contained in the ink cause association by ionic interaction to separate from solution phase at a moment.

Next, as the second stage of reaction, an association body of the above-mentioned dye and low molecule cation type substance or cation type oligomer is absorbed by high molecule components included in the processing liquid. Therefore, the coagulated body of the dye becomes further greater in size to become difficult to penetrate into the gap between the fiber of the printing medium. As a result, only the liquid portion resulting from solid/liquid separation penetrates into the printing paper, both of printing quality and sensibility can be achieved. At the same time, viscosity of the coagulated body formed of the low molecule component of the cation substance or cation type oligomer, anion type dye and cation type substance, is increased to so as not to move according to movement of the liquid medium. Therefore, even when the adjacent ink dots are formed with different colors as in formation of a full color image, the color may not be mixed to each other. Therefore, bleeding is not caused. Also, since the coagulated body is essentially water insoluble, the moisture resistance of the formed image becomes complete. Also, color fastness to light of the formed image can be improved by the shielding effect of the polymer.

It should be noted that the kind of the printing medium is not specified in implementation of the present invention, and conventionally used plain paper, such as copy paper, bond paper and so forth can be suitably used. Of course, a coated paper specially prepared for ink-jet printing, transparent film for OHP and so forth may also be used suitably. Also, general wood free paper, glossy paper and so forth ray also used suitably.

Embodiment 1

FIGS. 5A–5L are illustrations for explaining a printing method of a first embodiment of the present invention.

FIG. 5A shows print data.

In FIG. 5A, Y, R, G and B represent that respective pixels are printed with yellow, red, green and blue, respectively, and suffix numerals indicate tone levels of the pixels, respectively. Numerals 1 to 10 are pixel numbers in a scanning direction. As shown in FIG. 5A, the pixels are arranged along the scanning direction and along a direction perpendicular to the scanning direction.

FIG. 5B shows ejecting data of respective inks for forming respective pixels in accordance with the print data shown in FIG. 5A. For example, a pixel of a first line and a fifth column is formed of two Y-ink droplets and two M-ink droplets.

FIGS. 5C and 5D show ejecting data for ejecting Y-ink, FIGS. 5E and 5F show ejecting data for ejecting M-ink, and FIGS. 5G and 5H show ejecting data for ejecting C-ink. These ink droplets may be assigned to scanning cycles by, for example, a method disclosed in Japanese Patent Application Laid-open No. 155036/1993.

FIGS. 5I and 5J show ejecting data for the liquid S. As is clear from FIGS. 5B, 5I and 5J, the liquid S is ejected for all the pixels in which the ejecting data exist in the first and the second scanning cycle in a complementary manner in all the pixels to which the liquid S is to be ejected.

Incidentally, the heads are arranged in an order of S, K, C, M and Y, as shown in FIG. 2, and therefore the liquid S and the respective inks are ejected onto the printing sheet in order of arrangement of the heads. Therefore, when the printing operation is performed according to the ejecting data shown in FIGS. 5C to 5J, the ink is ejected following an ink ejecting order shown in FIGS. 5K and 5L.

As mentioned above in connection with the description of the related art, in the case of performing printing by two scanning cycles by the multi-scanning system, when the processing liquid is ejected in the first scanning cycle, developing of color and suppressing of feathering can be improved, but cockling and bleeding are liable to be caused. On the other hand, when the processing liquid is ejected in the second scanning cycle, suppressing of cockling and bleeding though, problems attributable to developing of color and feathering arises in regions into which no processing liquid was ejected in the first scanning cycle.

According to the shown embodiment, ejection timing of the processing liquid are evenly assigned to two scanning cycles, substantially, as shown in FIGS. 5I and 5J. By this, the advantages and disadvantages of the use of the processing liquid counterbalance each other and, consequently, a well-balanced printing operation can be performed. In addition, according to the processing liquid ejecting method of the shown embodiment, in most cases, the processing liquid is ejected to pixels adjacent to pixels to which the inks are ejected in the first scanning cycle during which the processing liquid is not ejected, so that feathering rarely occurs in a range beyond successive pixels.

It should be noted that although zero, one or two ink droplets of each color are ejected for each pixel in the embodiment set forth above, naturally, more than two ink droplets of the same color may be ejected for each pixel in the present invention.

Second Embodiment

Figure 6:
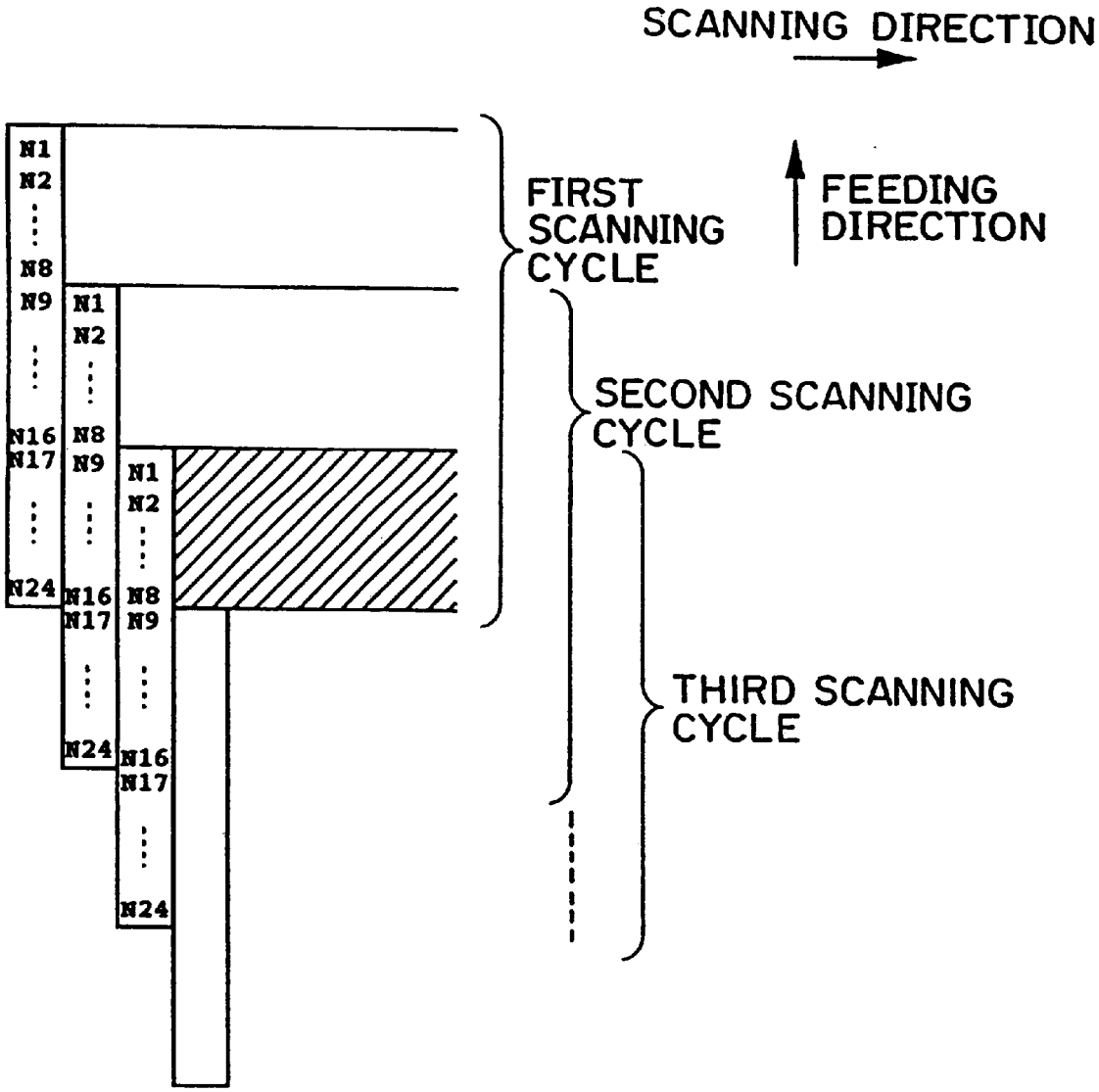
FIG. 6 is a diagrammatic view explaining a printing operation according to the second embodiment.

An ink-jet printing method in the shown embodiment is substantially the same in operation as the ink-jet printing method in the first embodiment, except that the former uses an ink-jet printing apparatus provided with heads each provided with twenty-four ejection openings, prints one line of pixels by three scanning cycles as shown in FIG. 6, and uses zero, one, two or three ink droplets for forming each pixel.

FIG. 7A shows print data by way of example, FIG. 7B shows ejecting data based on the print data shown in FIG. 7A, and FIGS. 7C, 7D and 7E show ejecting data for the first to the third scanning cycles, respectively. An ejecting method according to the ejecting data is the same as a method disclosed in Japanese Patent Application Laid-open No. 155036/1993. FIGS. 7F, 7G and 7H show ejecting data for ejecting the processing liquid S in the first to the third scanning cycles. As is obvious from FIGS. 7F, 7G and 7H, the processing liquid is ejected in a complimentary manner for all the pixels to be printed. By this, as mentioned in connection with the description of the first embodiment, advantages of the use of the liquid S can be secured, disadvantages of the use of the liquid S are suppressed.

Consequently, images well-balanced in developing of color, feathering, cockling and bleeding can be obtained.

Third Embodiment

An ink-jet printing method of the shown embodiment uses the same ink-jet printing apparatus of the second embodiment and carries out the same steps as those previously explained with reference to FIG. 6. With respect to print data shown in FIG. 7A, the inks are ejected according to the ejecting data shown in FIGS. 7B, 7C, 7D and 7E. However, the ejecting method of the printing liquid S in the shown embodiment is different from that of the second embodiment, and is one according to ejecting data shown in FIGS. 8A to 8C.

As shown in FIG. 8A, since no processing liquid is ejected in the first scanning cycle, cockling can be suppressed, but is liable to affect adversely to development of color and to cause feathering. Half the processing liquid to be ejected is ejected during the second scanning cycle, and the rest is ejected during the third scanning cycle so that S-droplets are ejected in a complementary manner for all the pixels to be formed.

Thus, images well-balanced in coloring, feathering and bleeding can be obtained.

Fourth Embodiment

An ink-jet printing method in the shown embodiment is the same as that of the third embodiment, except that the former ejects the processing liquid according to ejecting data shown in FIGS. 9A to 9C.

Since the processing liquid is ejected in the first scanning cycle as shown in FIG. 9A, whereas cockling is rather liable to occur, developing of color can be improved and feathering can be suppressed.

This ink-jet printing method is rather liable to cause the inks to run and bleed because the processing liquid ejected in the first scanning cycle and ink ejected in the second scanning cycle tend to permeate the printing sheet. However, since all the necessary ink is not ejected in the first and the second scanning cycles and the ink runs scarcely, so that bleeding, if any, is scarcely conspicuous.

The processing liquid ejected in the third scanning cycle are complementary to those ejected in the first scanning cycle. Therefore, the processing liquid and the inks interact in pixels for which the processing liquid has been ejected to inhibit bleeding. Since processing liquid ejected for pixels adjacent to those for which any processing liquid is not ejected, bleeding rarely occurs in a range beyond successive two pixels.

Ink usable for carrying out the present invention should not be limited only to dyestuff ink, and pigment ink having pigment dispersed therein can also be used. Any type of treatment liquid can be used, provided that pigment is aggregated with it. The following pigment ink can be noted as an example of pigment ink adapted to cause aggregation by mixing with the treatment liquid A1 previously discussed. As mentioned below, yellow ink Y2, magenta ink M2, cyan ink C2 and black ink K2 each containing pigment and anionic compound can be obtained.

[Black ink K2]

The following materials are poured in a batch type vertical sand mill (manufactured by Aimex Co.), glass beads each having a diameter of 1 mm is filled as media using anion based high molecular weight material P-1 (aqueous solution containing a solid ingredient of styrene methacrylic acid ethylacrylate of 20% having an acid value of 400 and average molecular weight of 6000, neutralizing agent:potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

(Composition of carbon black dispersing element)

| | |
|---|---|
| • P-1 aqueous solution (solid ingredient of 20%) | 40 parts |
| • carbon black Mogul L (manufactured by Cablack Co.) | 24 parts |
| • glycerin | 15 parts |
| • ethylene glycol monobutyl ether | 0.5 parts |
| • isopropyl alcohol | 3 parts |
| • water | 135 parts |

Next, the thus obtained dispersing element is sufficiently dispersed in water, and black ink K2 containing pigment for ink jet printing is obtained. The final product has a solid ingredient of about 10%.

[Yellow ink Y2]

Anionic high molecular P-2 (aqueous solution containing a solid ingredient of 20% of stylen-acrlylic acid methyl methaacrylate having an acid value of 280 and an average molecular weight of 11,000, neutralizing agent: diethanolamine) is used. as a dispersing agent and dispersive treatment is conducted in the same manner as production of the black ink K2 whereby a yellow color dispersing element having a weight-average grain size of 103 nm is produced.

(composition of yellow dispersing element)

| | |
|---|---|
| • P-2 aqueous solution (having a solid ingredient of 20 %) | 35 parts |
| • C.I. pigment yellow 180 (tradename : Nobapalm yellow PH-G, manufactured by Hext Co.) | 24 parts |
| • triethylen glycol | 10 parts |
| • diethylenglycol | 10 parts |
| • ethylene glycol monobutylether | 1.0 parts |
| • isopropyl alcohol | 0.5 parts |
| • water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan ink C2]

Cyan colored-dispersant element having a weight-average grain size of 120 nm is produced using anionic high molecular P-1 as dispersing agent, and moreover, using the following materials by conducting dispersing treatment in the same manner as the carbon black dispersing element.

(composition of cyan colored-dispersing element)

| | |
|---|---|
| • P-1 aqueous solution (having solid ingredient of 20%) | 30 parts |
| • C.I. pigment blue 153 (trade name : Fastogen blue FGF, manufactured by Dainippon Ink And Chemicals, Inc.) | 24 parts |
| • glycerin | 15 parts |
| • diethylenglycol monobutylether | 0.5 parts |
| • isopropyl alcohol | 3 parts |
| • water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta ink M2}

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

(composition of the magenta colored dispersing element)

| | |
|---|---|
| • P-1 aqueous solution (having a solid ingredient of 20%) | 20 parts |
| • C.I. pigment red 122 (manufactured by Dainippon Ink And Chemicals, Inc.) | 24 parts |
| • glycerin | 15 parts |
| • isopropyl alcohol | 3 parts |
| • water | 135 parts |

Magenta ink M2 for ink jet printing and having pigment contained therein is obtained by sufficiently dispersing the magenta colored dispersing element in water. The final product of ink has a solid ingredient of about 9.2%.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, a capping means and a cleaning means for the recording head, and a pressure or suction means for the recording head are known. As examples of the preliminary auxiliary system, a preliminary heating means utilizing electrothermal transducers or a combination of other heater elements and the electrothermal transducers, and a means for carrying out preliminary ejection of ink independently of the ejection for recording are known. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Figure 10:
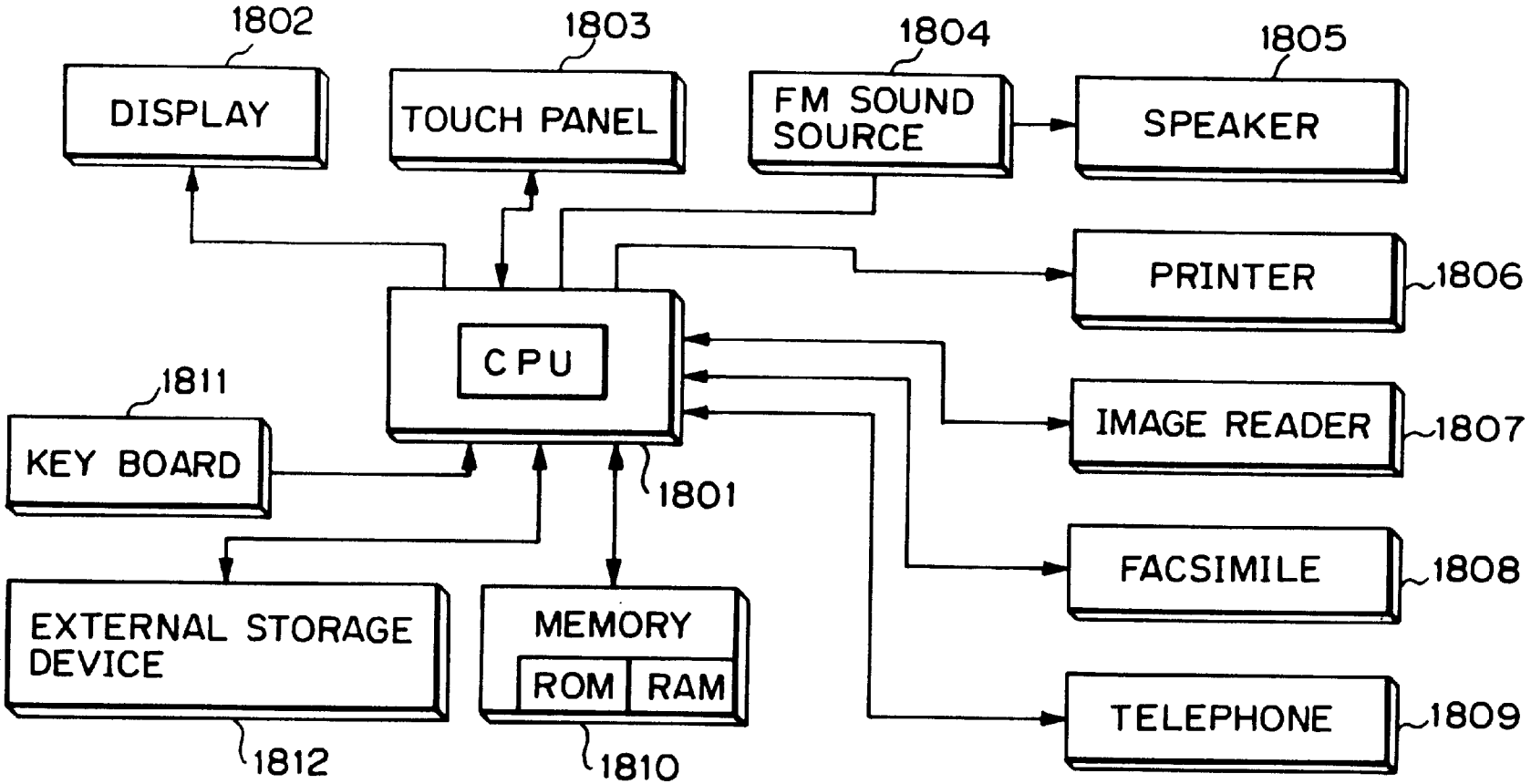
FIG. 10 is a block diagram of an information processing system employing an ink-jet printing apparatus embodying the present invention.

FIG. 10 is a block diagram showing general construction of an information processing apparatus having a function of wordprocessor, personal computer, facsimile machine, a copy machine and so forth, to which the printing apparatus according to the present invention is applied.

In the drawings, a reference numeral 1801 denotes a control portion performing control of the overall apparatus, which includes an CPU, such as a microprocessor and so forth, and various I/O ports, to perform control for outputting a control signal or a data signal and so forth to respective portions and inputting a control signal or a data signal from the respective portions. A reference numeral 1802 denotes a display portion having a display screen, on which various menu, document information and image or so forth read by an image reader 1807 are displayed. A reference numeral 1803 denotes a transparent pressure sensitive touch panel provided on the display portion 1802 for performing item entry or coordinate portion entry on the display portion 1802 by depressing the surface thereof by a finger or so forth.

A reference numeral 1804 denotes a FM (frequency modulation) sound source portion which stores music information produced by a music editor and so forth in a memory portion 1810 or an external memory 1812 and performs FM modulation by reading out the stored music information from the memory portion 1810 or so forth. An electric signal from the FM sound source portion 1804 is transformed into an audible sound by a speaker portion 1805. A printer portion 1806 is employed as an output terminal of the wordprocessor, the personal computer, the facsimile machine, the copy machine and so forth, in which the printing apparatus according to the present invention is applied.

A reference numeral 1807 denotes an image reader portion to optoelectrically read out an original data for inputting, which is located at the intermediate position in an original feeding path and performs reading out various original documents, such as original documents for a facsimile machine or copy machine. A reference numeral 1808 denotes a facsimile (FAX) transmission and reception portion for transmitting original data read by the image reader portion or for receiving transmitted facsimile signals, which facsimile transmission and reception portion has an external interface function. A reference numeral 1809 denotes a telephone machine portion having a normal telephone function and various associated functions, such as a recording telephone and so forth.

A reference numeral 1810 denotes a memory portion including a ROM storing a system program, a manager program, other application program and so forth, as well as character fonts, dictionary and so forth, a RAM for storing application program loaded from an external storage device 1812, document information, video information and so forth.

A reference numeral 1811 denotes a keyboard portion inputting document information or various commands. A reference numeral 1812 denotes the external storage device employing a floppy disc or hard disc drive as storage medium. In the external storage device 1812, document information, music or speech information, application program of the user and so forth are stored.

Figure 11:
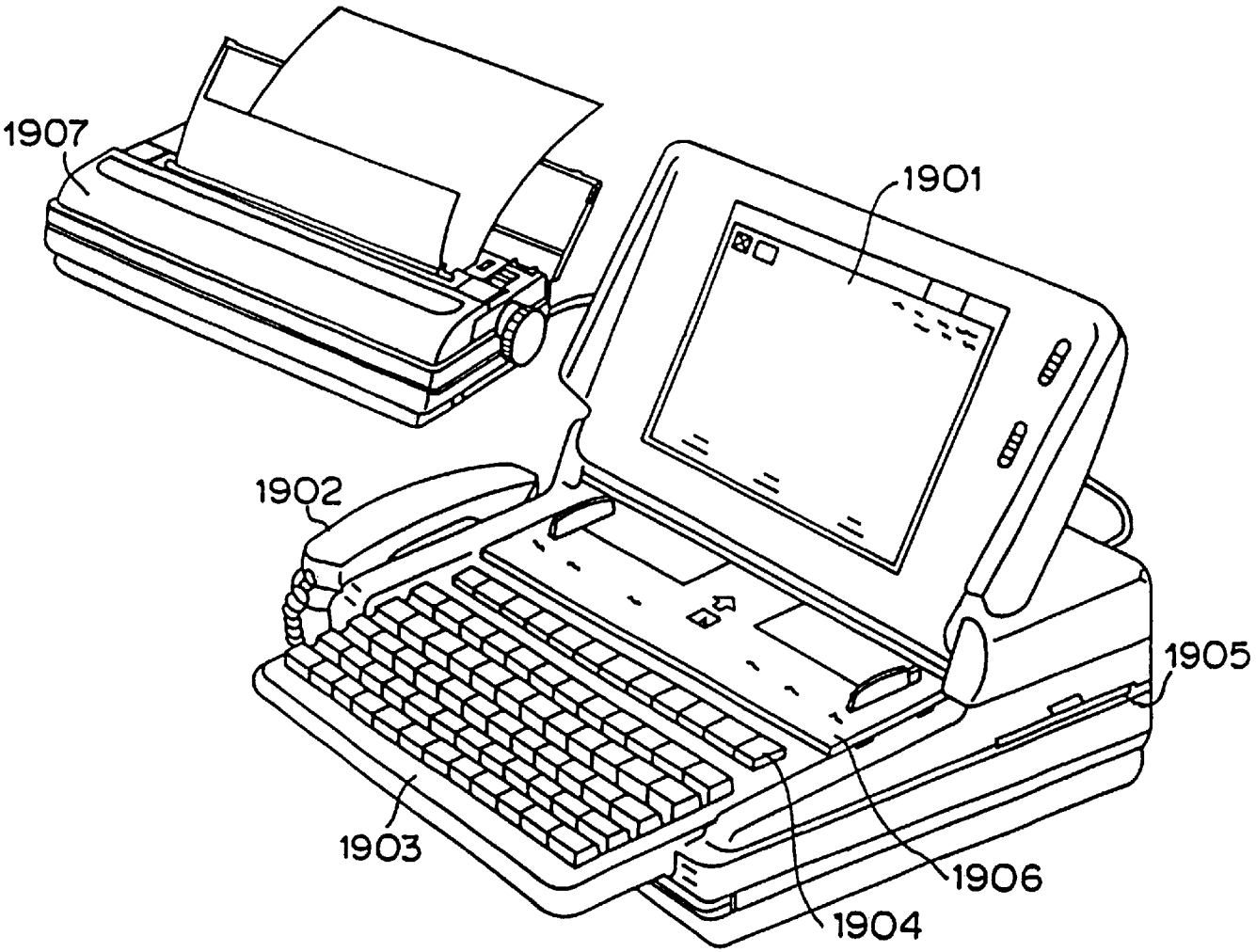
FIG. 11 is a perspective view of the information processing system of FIG. 10.

FIG. 11 is a diagrammatic external view of the information processing system shown in FIG. 10.

In FIG. 11, a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion mouth of the external storage device 1812 for accommodating a floppy disk inserted thereinto.

A reference numeral 1906 denotes a paper stacking portion for stacking the original to be read by the image reader portion 1807. The original read by the image reader portion is discharged from the back portion of the apparatus. On the other hand, in facsimile reception, the received information is printed by the ink-jet printer 1907.

It should be noted that while the display portion 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth apparatus is operated as the personal computer or the wordprocessor, various information input through the keyboard portion 1811 is processed according to a predetermined program by the control portion 1801 and output as printed image by the printer portion 1806.

When the information processing apparatus is operated as a receiver of the facsimile machine, facsimile information input from the FAX transmission and reception portion 1808 via a communication network is subject to a reception process according to the predetermined program and output as received image by the printer portion 1808.

In addition, when the information processing apparatus is operated as a copy machine, the original is read by the image reader portion 1807 and the read original data is output to the printer portion as a copy image via the control portion 1801. It should be noted that, when the information processing apparatus is used as the transmitter of the facsimile machine, the original data read by the image reader 1807 is processed for transmission according to the predetermined program by the control portion, and thereafter transmitted to the communication network via the FAX transmission and reception portion 1808.

Figure 12:
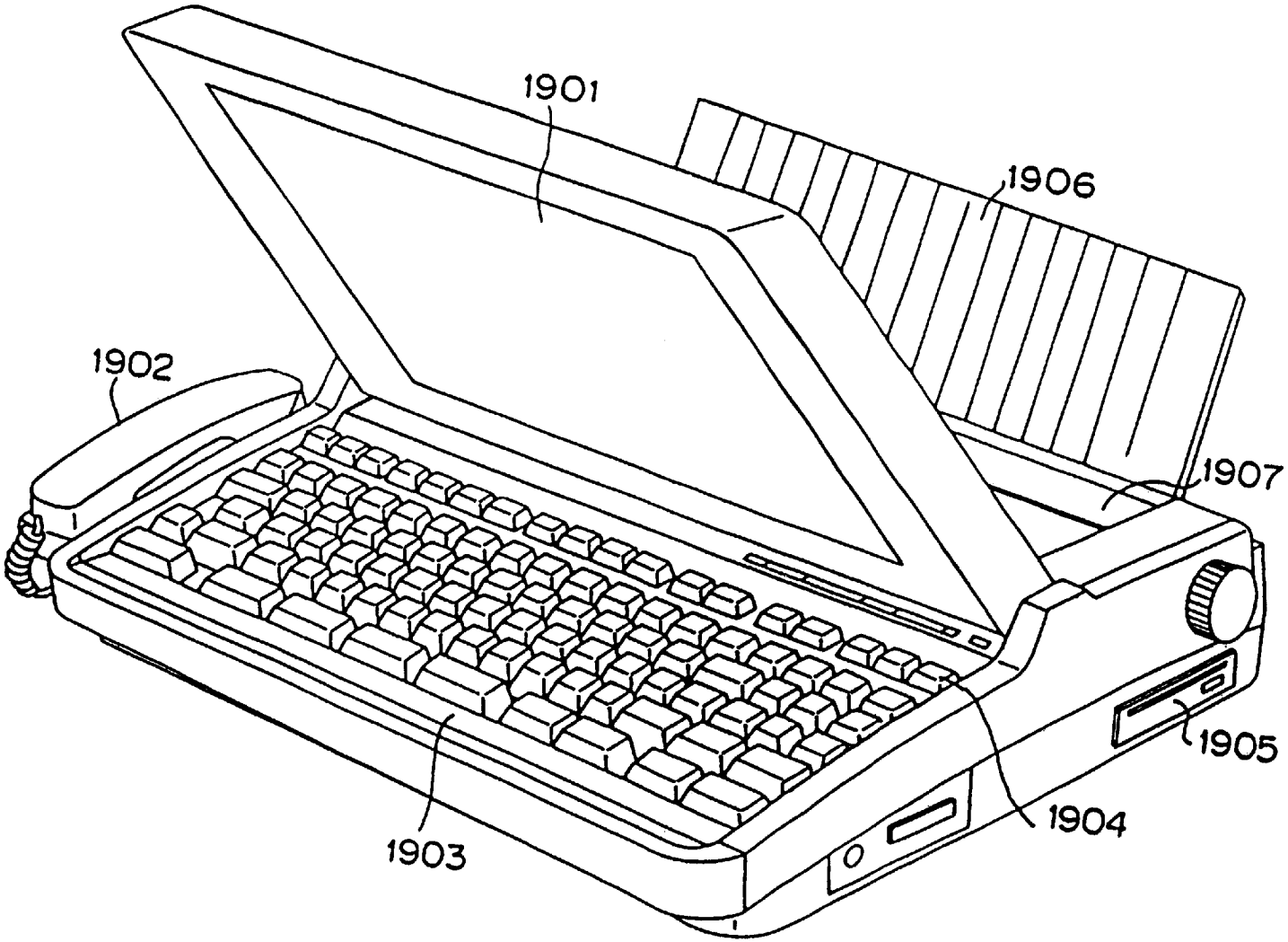
FIG. 12 is another information processing system employing an ink-jet printing apparatus embodying the present invention.

It should be noted that the information processing apparatus may be an integrated type incorporating the ink-jet printer within a main body as illustrated in FIG. 12. In this case, portability can be further improved. In FIG. 12, the portions having the same function to FIG. 11 are shown with the corresponding reference numerals.

As set forth above, a multi-function type information processing apparatus may obtain high quality printed images at high speed and low noise by employing the printing apparatus of the present invention. Therefore, the functions of the information processing apparatus can be further enhanced.

As is apparent from the foregoing description, according to the present invention, droplets of the processing liquid are ejected in a plurality of scanning cycles respectively for divisions of a print region, in which pixels are to be formed and, therefore the processing liquid acts effectively on ink droplets in each division of the print region, and the advantages and disadvantages of the use of the dye insulubilizing liquid counterbalance each other.

What is claimed is:

1. An ink-jet printing apparatus for performing printing by ejecting an ink from an ink ejecting portion in accordance with ejection data and a liquid at least containing a material which insolubilizes or coagulates a coloring material in the ink from a liquid ejecting portion, to a printing medium, said apparatus comprising:

a printing controller for dividing a predetermined print region to be printed by the ink ejected from said ink ejecting portion into a plurality of divided print regions in accordance with a pixel pattern corresponding to the ejection data, and for scanning the liquid ejecting portion a plurality of scanning times to perform ejection of the liquid from the liquid ejecting portion for each of the plurality of divided print regions, wherein the liquid is not ejected during any of the plurality of scanning times to a pixel to which the ink is not ejected, and the liquid is not ejected to more than one pixel of a group of adjacent pixels in a scanning direction during any one scanning of the liquid ejecting portion.

2. An ink-jet printing apparatus as claimed in claim 1, wherein said printing controller controls said ink ejecting portion to scan in the predetermined region a plurality of times.

3. An ink-jet printing apparatus as claimed in claim 2, wherein the pixel pattern is a complementary pattern.

4. An ink-jet printing apparatus as claimed in claim 3, wherein the liquid contains a low-molecular weight cationic substance and a high-molecular weight cationic substance, and the ink contains an anionic dye.

5. An ink-jet printing apparatus as claimed in claim 3, wherein the liquid contains a low-molecular weight cationic substance and a high-molecular weight cationic substance, and the ink contains an anionic compound and a pigment.

6. An ink-jet printing apparatus as claimed in claim 5, wherein said ink ejecting portion and said liquid ejecting portion produce bubbles in the ink and the liquid, respectively, by using thermal energy to eject the ink and the liquid by the agency of the bubbles.

7. An ink-jet printing method for performing printing by ejecting an ink in accordance with election data and a liquid at least containing a material which insolubilizes or coagulates a coloring material in the ink, to a printing medium, said method comprising the steps of:

providing an ink ejecting portion for ejecting the ink, and a liquid ejecting portion for ejecting the liquid;

ejecting the ink from said ink ejecting portion onto a predetermined region on a printing medium; and ejecting the liquid from said liquid ejecting portion at a plurality of timings by scanning the liquid ejecting portion a plurality of scanning times across the predetermined region, the liquid being ejected to different divided regions determined by dividing a predetermined region in accordance with a pixel pattern corresponding to the election data in accordance with the plurality of times of scanning, and controlling ejection such that the liquid is not ejected during any of the plurality of scanning times to a pixel to which the ink is not ejected, and the liquid is not ejected to more than one pixel of a group of adjacent pixels in a scanning direction during any one scanning of the liquid ejecting portion.

8. An ink-jet printing method as claimed in claim 7, wherein the liquid is ejected onto the printing medium from a plurality of liquid ejecting portions.

9. An ink-jet printing method as claimed in claim 7, wherein the liquid is ejected onto the printing medium at a plurality of different times, so that deposition patterns of said liquid are complementary to each other.

10. An ink-jet printing method as claimed in claim 7, wherein a liquid ejecting signal for the liquid is generated by dividing ink ejecting signals for ejecting respective inks of different colors into patterns complementary to each other.

11. An ink-jet printing method as claimed in claim 10, wherein at least one of the patterns in which the liquid is ejected onto the printing medium is a checkered pattern.

12. An ink-jet printing method as claimed in claim 11, wherein the patterns complementary to each other are formed by dividing a pattern into two patterns.

13. An ink-jet printing method as claimed in claim 12, wherein the patterns complementary to each other are a checkered pattern and an inverse checkered pattern inverse to the former.

14. An image forming apparatus comprising:

(a) an ink-jet printing apparatus for performing printing by ejecting an ink from an ink ejecting portion in accordance with ejection data and a liquid at least containing a material which insolubilizes or coagulates a coloring material in the ink from a liquid ejecting portion, to a printing medium, said apparatus comprising:

a printing controller for dividing a predetermined print region to be printed by the ink ejected from said ink ejecting portion into a plurality of divided print regions in accordance with a pixel pattern corresponding to the ejection data, and for scanning the liquid ejecting portion a plurality of scanning times to perform ejection of the liquid from the liquid ejecting portion for each of the plurality of divided print regions, wherein the liquid is not ejected during any of the plurality of scanning times to a pixel to which the ink is not ejected, and the liquid is not ejected to more than one pixel of a group of adjacent pixels in a scanning direction during any one scanning of the liquid ejecting portion; and (b) an image reading unit for reading an original image and for generating corresponding print data, wherein said ink-jet printing apparatus performs printing on a basis of the print data corresponding to the original image read by said image reading unit.

15. An image forming apparatus comprising:

(a) an ink-jet printing apparatus for performing printing by ejecting an ink from an ink ejecting portion in accordance with ejection data and a liquid at least containing a material which insolubilizes or coagulates a color material in the ink from a liquid ejecting portion, to a printing medium, said apparatus comprising:

a printing controller for dividing a predetermined print region to be printed by the ink ejected from said ink ejecting portion into a plurality of divided print regions in accordance with a pixel pattern corresponding to the ejection data, and for scanning the liquid ejecting portion a plurality of scanning times to perform ejection of the liquid from the liquid ejecting portion for each of the plurality of divided print regions, wherein the liquid is not ejected during any of the plurality of scanning times to a pixel to which the ink is not ejected, and the liquid is not ejected to more than one pixel of a group of adjacent pixels in a scanning direction during any one scanning of the liquid ejecting portion; and (b) a print data sending and receiving unit for sending print data to and for receiving print data from an external apparatus, wherein said ink-jet printing apparatus performs printing on a basis of print data received by said print data sending and receiving unit.

16. An information processing apparatus comprising:

(a) an ink-jet printing apparatus for performing printing by ejecting an ink from an ink ejecting portion in accordance with ejection data and a liquid at least containing a material which insolubilizes or coagulates a coloring material in the ink from a liquid ejecting portion, to a printing medium, said apparatus comprising:

a printing controller for dividing a predetermined print region to be printed by the ink ejected from said ink ejecting portion into a plurality of divided print regions in accordance with a pixel pattern corresponding to the ejection data, and for scanning the liquid ejecting portion a plurality of scanning times to perform ejection of the liquid from the liquid ejecting portion for each of the plurality of divided print regions, wherein the liquid is not ejected during any of the plurality of scanning times to a pixel to which the ink is not ejected, and the liquid is not ejected to more than one pixel of a group of adjacent pixels in a scanning direction during any one scanning of the liquid ejecting portion; and (b) a computer for providing print data, wherein said ink-jet printing apparatus performs printing on a basis of the print data provided by the computer.

17. An ink-jet printing apparatus employing an ink ejecting portion for ejecting ink containing a coloring material and a liquid ejecting portion for ejecting a liquid containing a material which insolubilizes or coagulates the coloring material in the ink to perform printing in which the ink ejecting portion and the liquid ejecting portion are caused to scan a predetermined printing region on a printing medium a plurality of times and, during each of the plurality of scans, are caused to eject the ink and the liquid to the predetermined printing region, respectively, based on respective ink ejection data and liquid ejection data, said apparatus comprising:

ink ejecting data deciding means for dividing the ink ejecting data for the predetermined printing region into a plurality of complementary sets of ink ejecting data and, for each of the plurality of complementary sets of ink ejecting data, deciding a scan during which ink ejection based on the respective complementary set of ink ejecting data is performed, among the plurality of scans;

liquid ejecting data deciding means for dividing the liquid ejecting data for the predetermined printing region into a plurality of complementary sets of liquid ejecting data and, for each of the plurality of complementary sets of liquid ejecting data, deciding a scan during which liquid ejection based on the respective complementary set of liquid ejecting data is performed, among the plurality of scans; and printing means for causing the ink ejecting portion and the liquid ejecting portion to eject the ink and the liquid, respectively, during each scan of the plurality of scans, based on the complementary sets of ink ejecting data and the complementary sets of liquid ejecting data, respectively, said each scan being decided by said ink ejecting data deciding means and said liquid ejecting data deciding means, so as to complete printing for the predetermined printing region in which (a) a first portion formed in such a manner that the ink is ejected on the liquid ejected during a first scan, which is a scan first carried out for the predetermined printing region, and (b) a second portion formed in such a manner that the liquid is ejected, during a second scan carried out after the first scan, on a portion formed only with the ink ejected during the first scan, exist together, wherein said ink ejecting data deciding means and said liquid ejecting data deciding means divide the ink ejecting data and the liquid ejecting data and decide the scans during which the ink ejection and the liquid ejection are performed, respectively, so that the first portion and the second portion exist together in the predetermined printing region.

18. An ink-jet printing apparatus as claimed in claim 17, wherein the predetermined printing region is composed of a plurality of pixel regions, the liquid is not ejected to a pixel region to which the ink is not ejected, and one droplet of the liquid is ejected to a pixel region.

19. An ink-jet printing apparatus as claimed in claim 18, wherein a plurality of droplets of the ink is ejected to the pixel region.

20. An ink-jet printing apparatus as claimed in claim 17, wherein, during each scan, the ink is ejected after the liquid is ejected.

21. An ink-jet printing apparatus as claimed in claim 17, wherein the ink includes inks of different colors and the liquid ejecting data is generated by taking a logical sum of the ink ejecting data of the inks of different colors.

22. An ink-jet printing apparatus as claimed in claim 17, wherein the liquid has a property that improves color developing of the coloring material in the ink.

23. An ink-jet printing method of employing an ink ejecting portion for ejecting ink containing a coloring material and a liquid ejecting portion for ejecting a liquid containing a material which insolubilizes or coagulates the coloring material in the ink to perform printing in which the ink ejecting portion and the liquid ejecting portion are caused to scan a predetermined printing region on a printing medium a plurality of times and, during each of the plurality of scans, are caused to eject the ink and the liquid to the predetermined printing region, respectively, based on respective ink ejection data and liquid ejection data, said method comprising:

an ink ejecting data deciding step, of dividing the ink ejecting data for the predetermined printing region into a plurality of complementary sets of ink ejecting data and, for each of the plurality of complementary sets of ink ejecting data, deciding a scan during which ink ejection based on the respective complementary set of ink ejecting data is performed, among the plurality of scans;

a liquid ejecting data deciding step, of dividing the liquid ejecting data for the predetermined printing region into a plurality of complementary sets of liquid ejecting data and, for each of the plurality of complementary sets of liquid ejecting data, deciding a scan during which liquid ejection based on the respective complementary set of liquid ejecting data is performed, among the plurality of scans; and a printing step, of causing the ink ejecting portion and the liquid ejecting portion to eject the ink and the liquid, respectively, during each scan of the plurality of scans, based on the complementary sets of ink ejecting data and the complementary sets of liquid ejecting data, respectively, said each scan being decided in said ink ejecting data deciding step and said liquid ejecting data deciding step, so as to complete printing for the predetermined printing region in which (a) a first portion formed in such a manner that the ink is ejected on the liquid ejected during a first scan, which is a scan first carried out for the predetermined printing region, and (b) a second portion formed in such a manner that the liquid is ejected, during a second scan carried out after the first scan, on a portion formed only with the ink ejected during the first scan, exist together, wherein said ink ejecting data deciding step and said liquid ejecting data deciding step include dividing the ink ejecting data and the liquid ejecting data and deciding the scans during which the ink ejection and the liquid ejection are performed, respectively, so that the first portion and the second portion exist together in the predetermined printing region.

24. An ink-jet printing method as claimed in claim 23, wherein the predetermined printing region is composed of a plurality of pixel regions, the liquid is not ejected to a pixel region to which the ink is not ejected, and one droplet of the liquid is ejected to a pixel region.

25. An ink-jet printing method as claimed in claim 24, wherein a plurality of droplets of the ink is ejected to the pixel region.

26. An ink-jet printing method as claimed in claim 24, wherein, during each scan, the ink is ejected after the liquid is ejected.

27. An ink-jet printing method as claimed in claim 23, wherein the ink includes inks of different colors and the liquid ejecting data is generated by taking a logical sum of the ink ejecting data of the inks of different colors.

28. An ink-jet printing method as claimed in claim 23, wherein the liquid has a property that improves color developing of the coloring material in the ink.

* * * * *

UNITED STATES PATENT AND TRADEMARK OFFICE

CERTIFICATE OF CORRECTION

PATENT NO. : 6,325,502 B1
DATED : December 4, 2001
INVENTOR(S) : Makoto Shioya et al.

It is certified that error appears in the above-identified patent and that said Letters Patent is hereby corrected as shown below:

Title page,
Item [56], FOREIGN PATENT DOCUMENTS,

| | | | |
|---|---|---|---|
| "54056847 | | 5/1979 | (JP). |
| 55084992 | | 6/1980 | (JP). |
| 58128862 | | 8/1983 | (JP). |
| 59123670 | | 7/1984 | (JP). |
| 59138461 | | 8/1984 | (JP). |
| 60071260 | | 4/1985 | (JP). |
| 61249755 | | 11/1986 | (JP). |
| 63299971 | * | 7/1988 | (JP). |
| 63312841 | | 12/1988 | (JP). |
| 6463185 | | 3/1989 | (JP). |
| 1114450 | | 5/1989 | (JP). |
| 3207665 | | 9/1991 | (JP). |
| 4358847 | | 12/1992 | (JP). |
| 5155036 | | 6/1993 | (JP)." |

should read

| | | | |
|---|---|---|---|
| -- 54-056847 | | 5/1979 | (JP). |
| 55-084992 | | 6/1980 | (JP). |
| 58-128862 | | 8/1983 | (JP). |
| 59-123670 | | 7/1984 | (JP). |
| 59-138461 | | 8/1984 | (JP). |
| 60-071260 | | 4/1985 | (JP). |
| 61-249755 | | 11/1986 | (JP). |
| 63-299971 | * | 7/1988 | (JP). |
| 63-312841 | | 12/1988 | (JP). |
| 64-63185 | | 3/1989 | (JP). |
| 1-114450 | | 5/1989 | (JP). |
| 3-207665 | | 9/1991 | (JP). |
| 4-358847 | | 12/1992 | (JP). |
| 5-155036 | | 6/1993 | (JP). --. |

Column 2,
Line 19, "above described" should read -- above-described --;
Line 44, "in" should read -- in a --.

Column 3,
Line 25, "has" should read -- have --.

UNITED STATES PATENT AND TRADEMARK OFFICE

CERTIFICATE OF CORRECTION

PATENT NO. : 6,325,502 B1
DATED : December 4, 2001
INVENTOR(S) : Makoto Shioya et al.

It is certified that error appears in the above-identified patent and that said Letters Patent is hereby corrected as shown below:

Column 8,
Line 39, "to" should read -- with --;
Line 51, "ray also"should read -- may also be --.

Column 11,
Line 9, "agent:po-" should read -- agent: po- --
Line 39, "used." should read -- used --.

Column 14,
Line 26, "an" should read -- a --.

Column 16,
Line 56, "election" should read -- ejection --.

Column 17,
Line 4, "election" should read -- ejection --.

Signed and Sealed this

Fourteenth Day of May, 2002

*Attest:*

*Attesting Officer*

JAMES E. ROGAN
*Director of the United States Patent and Trademark Office*